US007785118B2

(12) United States Patent
McCarthy

(10) Patent No.: US 7,785,118 B2
(45) Date of Patent: Aug. 31, 2010

(54) COAXIAL CABLE CONNECTOR HAVING A COMPENSATING TAB

(75) Inventor: Sean Patrick McCarthy, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 202 days.

(21) Appl. No.: 11/888,545

(22) Filed: Jul. 31, 2007

(65) Prior Publication Data

US 2009/0035990 A1 Feb. 5, 2009

(51) Int. Cl.
*H01R 13/648* (2006.01)

(52) U.S. Cl. ..... 439/98; 439/585; 439/610

(58) Field of Classification Search ..... 439/610, 439/585, 578–581, 394, 108
See application file for complete search history.

(56) References Cited

U.S. PATENT DOCUMENTS

| | | | | |
|---|---|---|---|---|
| 5,232,380 | A | 8/1993 | Inoue et al. | |
| 5,399,097 | A | 3/1995 | Sakai et al. | |
| 5,409,400 | A | 4/1995 | Davis | |
| 5,725,395 | A | 3/1998 | Lee | |
| 5,924,887 | A | 7/1999 | Aoyama et al. | |
| 6,065,998 | A | 5/2000 | Peloza | |
| 6,200,162 | B1 | 3/2001 | Aoyama et al. | |
| 6,203,369 | B1 | 3/2001 | Feldman | |
| 6,231,387 | B1 * | 5/2001 | Kameyama | 439/578 |
| 6,706,970 | B2 | 3/2004 | Laub et al. | |
| 6,746,268 | B2 | 6/2004 | Laub et al. | |
| 6,746,277 | B2 | 6/2004 | Laub et al. | |
| 6,814,615 | B2 | 11/2004 | Laub et al. | |
| 6,840,822 | B1 | 1/2005 | Hall et al. | |
| 6,878,011 | B2 | 4/2005 | Laub et al. | |
| 6,945,819 | B2 | 9/2005 | Laub et al. | |
| 6,988,911 | B2 | 1/2006 | McCarthy et al. | |
| 7,229,298 | B2 * | 6/2007 | Shen et al. | 439/95 |
| 2003/0049956 | A1 * | 3/2003 | Yoshida | 439/98 |
| 2003/0081425 | A1 | 5/2003 | Kumar et al. | |
| 2003/0104720 | A1 | 6/2003 | Laub et al. | |
| 2003/0104723 | A1 | 6/2003 | Laub et al. | |

FOREIGN PATENT DOCUMENTS

| | | | |
|---|---|---|---|
| EP | 1 291 981 | A2 | 3/2003 |

OTHER PUBLICATIONS

PCT International Search Report; International Application No. PCT/US2008/009181; International Filing Date Jul. 30, 2008; Applicant—Tyco Electronics Corporation.

* cited by examiner

*Primary Examiner*—Hien Vu

(57) ABSTRACT

A coaxial cable connector includes a connector housing configured to receive a coaxial cable having inner and outer conductors, and a ground shield including a plurality of walls cooperating to define a shielded chamber. The connector housing is received within the shielded chamber, and the walls are configured to be connected to the outer conductor of the coaxial cable. The coaxial cable connector also includes a center blade contact having a flat planar body, wherein the center blade contact is configured to be connected to the inner conductor of the coaxial cable. The center blade contact is supported by the connector housing between the walls of the ground shield in a stripline geometry. At least one of the walls includes a compensating tab extending inward therefrom, wherein the compensating tab is configured to be positioned proximate at least one of the center blade contact and the inner conductor of the coaxial cable.

18 Claims, 9 Drawing Sheets

COAXIAL CABLE CONNECTOR HAVING A COMPENSATING TAB

BACKGROUND OF THE INVENTION

This invention relates generally to electrical connector assemblies, and, more specifically, to connector assemblies for coaxial cables.

In the past, connectors have been proposed for interconnecting coaxial cables. Generally, coaxial cables have a circular geometry formed with a central conductor (of one or more conductive wires) surrounded by a cable dielectric material. The dielectric material is surrounded by a cable braid (of one or more conductive wires) that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, it is preferable that the impedance remain matched through the interconnection.

Today, coaxial cables are widely used. Recently, demand has arisen for radio frequency (RF) coaxial cables in applications such as the automotive industry. The demand for RF coaxial cables in the automotive industry is due in part to the increased electrical content within automobiles, such as AM/FM radios, cellular phones, GPS, satellite radios, Blue Tooth™ compatibility systems and the like. The wide applicability of coaxial cables demands that connected coaxial cables maintain the impedance at the interconnection.

Conventional coaxial connector assemblies include matable plug and receptacle assemblies. The assemblies include dielectric housings, metal outer shields, and center contacts. The assemblies receive and retain coaxial cable ends, and each of the outer shields enclose the housings. Portions of the shields may pierce the cable jackets to electrically contact the cable braids while the center contacts engage the central conductors. When the plug and receptacle assemblies are mated, the dielectric housings are engaged, the outer shields are interconnected and the center contacts are interconnected.

However, as transmission rates increase, impedance matching problems may arise due to the size, orientation, and placement of the cables, center contacts, and plug and receptacle assemblies of conventional coaxial connector assemblies.

Thus a need remains for a coaxial connector assembly capable of controlling the electrical characteristics through the interconnection in a cost effective and reliable manner.

BRIEF DESCRIPTION OF THE INVENTION

In one embodiment, a coaxial cable connector is provided including a connector housing configured to receive a coaxial cable having inner and outer conductors, and a ground shield including a plurality of walls cooperating to define a shielded chamber. The connector housing is received within the shielded chamber, and the walls are configured to be connected to the outer conductor of the coaxial cable. The coaxial cable connector also includes a center contact configured to be connected to the inner conductor of the coaxial cable. The center contact is supported by the connector housing between the walls of the ground shield in a stripline geometry. At least one of the walls includes a compensating tab extending inwardly therefrom, wherein the compensating tab is configured to be positioned proximate at least one of the center contact and the inner conductor of the coaxial cable.

Optionally, the compensating tab may be formed integral with the ground shield. The compensating tab may include a radial section extending generally perpendicular with respect to the wall of the ground shield and an axial section extending generally perpendicular with respect to the radial section. The axial section may extend substantially parallel to a longitudinal axis of the center contact and the radial section may extend between the axial section and the ground shield. Optionally, the compensating tab may be positioned with respect to the center contact to provide a predetermined impedance of the coaxial cable connector.

In another embodiment, a coaxial cable connector assembly is provided including a receptacle assembly, and a plug assembly configured for mating engagement with the receptacle assembly. At least one of the receptacle assembly and the plug assembly is configured for coupling to a coaxial cable having a center conductor and a ground conductor. At least one of the receptacle assembly and the plug assembly includes a contact configured for connection to the center conductor at a mating section of the contact, a dielectric housing configured to receive the contact and a portion of the cable, and a ground shield configured for connection to the ground conductor of the coaxial cable. The ground shield includes a plurality of walls defining a shielded chamber that receives the dielectric housing. At least one of the walls includes a compensating tab axially aligned with, and extending toward, the mating section of the contact.

Optionally, the receptacle assembly may include a mating contact configured for mating contact with the contact of the plug assembly, and a receptacle housing configured to receive the mating contact, wherein the receptacle housing has a mating face configured to engage a corresponding mating face of the dielectric housing. A receptacle ground shield may be provided that is configured for connection to the ground shield of the plug assembly, wherein the receptacle ground shield and the ground shield of the plug assembly cooperating to completely surround and shield the mating contact and the contact of the plug assembly. The mating contact may be configured for connection to a center conductor of a second coaxial cable, and the receptacle ground shield may be configured for connection to a ground conductor of the second coaxial cable. The receptacle ground shield may include a second compensating tab axially aligned with, and extending toward, the mating contact.

In a further embodiment, a ground shield is provided for a coaxial cable connector used with a coaxial cable having a center conductor and a ground conductor. The ground shield includes a primary shield having opposite side walls and a connecting wall extending therebetween, wherein the side walls and the connecting wall extend along a longitudinal axis and cooperate to define a shielded chamber configured to receive the coaxial cable and a contact connected to the center conductor of the coaxial cable. The primary shield includes at least one grounding tab configured to directly engage and electrically connect to the ground conductor of the coaxial cable. A compensating tab extends from the connecting wall toward a central portion of the shielded chamber, wherein the compensating tab is configured to be axially aligned with, and extend toward, the contact.

DETAILED DESCRIPTION OF THE INVENTION

Figure 1:
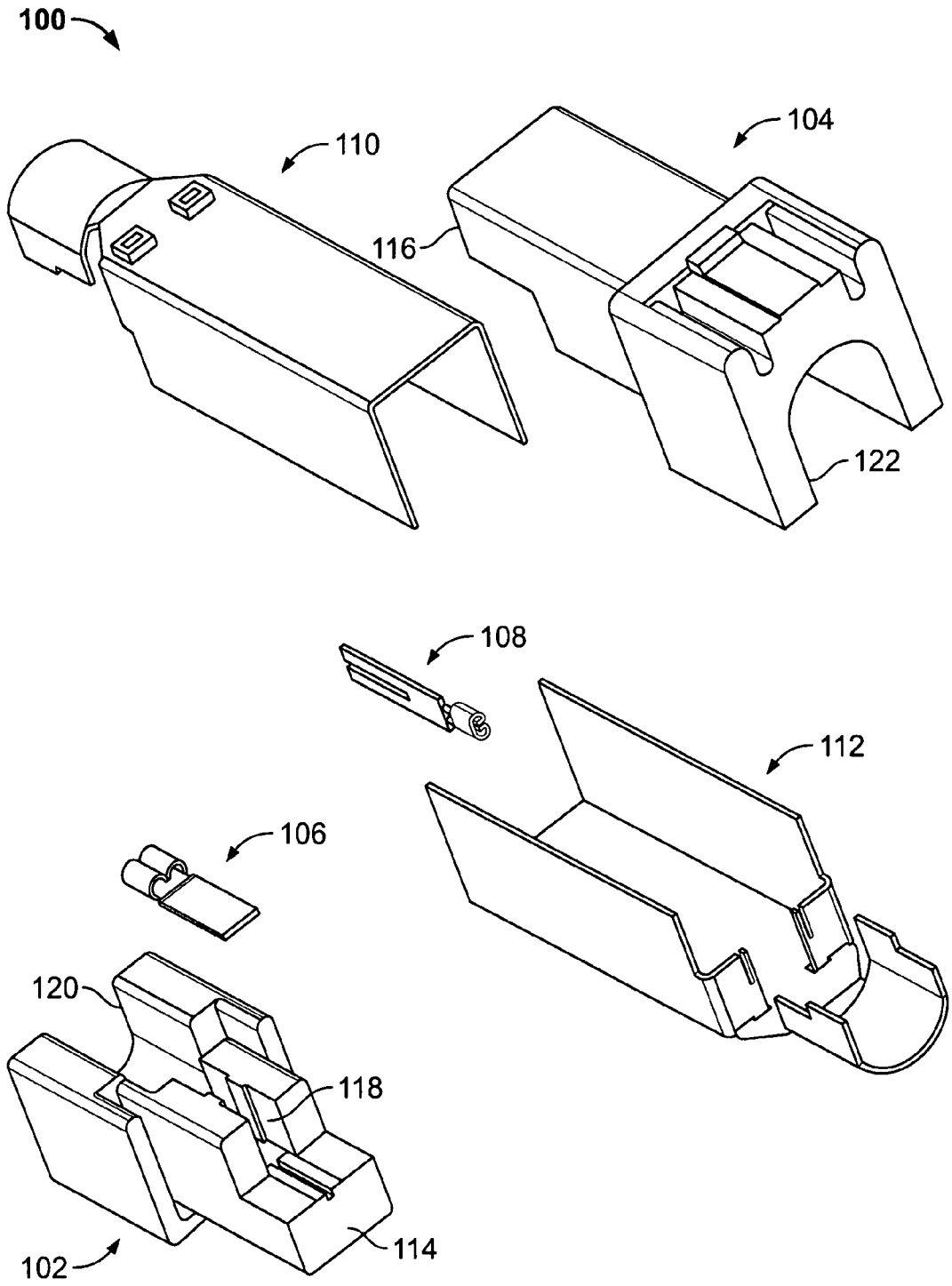
FIG. 1 (Prior Art)
FIG. 1 is an exploded view of a known connector assembly for a coaxial cable.

FIG. 1 illustrates a known coaxial cable connector assembly 100 which is shown to better understand the subject matter of the present invention which is described below. It is understood, however, that the shielding and compensation provided by the shielding of the present invention may be used generally in various types of coaxial cable connectors. The description set forth below is provided solely for purposes of illustrating the invention, and is not intended to limit the application of the invention to any particular connector.

The coaxial cable connector assembly 100 includes dielectric housings 102 and 104 corresponding to a respective plug and receptacle assembly, a plug contact 106, a receptacle contact 108, a plug shield 110 and a receptacle shield 112. The plug contact 106 and the receptacle contact 108 each define blade contacts having planar body sections. One of the contacts (the receptacle contact 108 in the illustrated embodiment) is forked to include a gap into which the other contact is fit, thus making electrical and mechanical contact therewith. The first and second dielectric housings 102 and 104 include mating faces 114 and 116, respectively, and a slot 118 proximate the mating face 114 accepts a portion of the plug contact 106. Another slot (not shown in FIG. 1) proximate the mating face 116 accepts a portion of the receptacle contact 108. The respective plug and receptacle contacts 106, 108 are crimped to center conductors of respective cables (not shown in FIG. 1), and when the plug is connected to the receptacle the plug contact 106 is electrically connected to the receptacle contact 108. Barrels 120 and 122 are provided in the dielectric housings 102 and 104 which receive the cables, and the shields 110 and 112 are attached to the cables over the dielectric housings 102 and 104.

While the connector assembly 100 is suitable for smaller cable applications, the shields 110 and 112 may benefit from additional mechanical stability and electrical shielding as the size of the cable increases.

Figure 2:
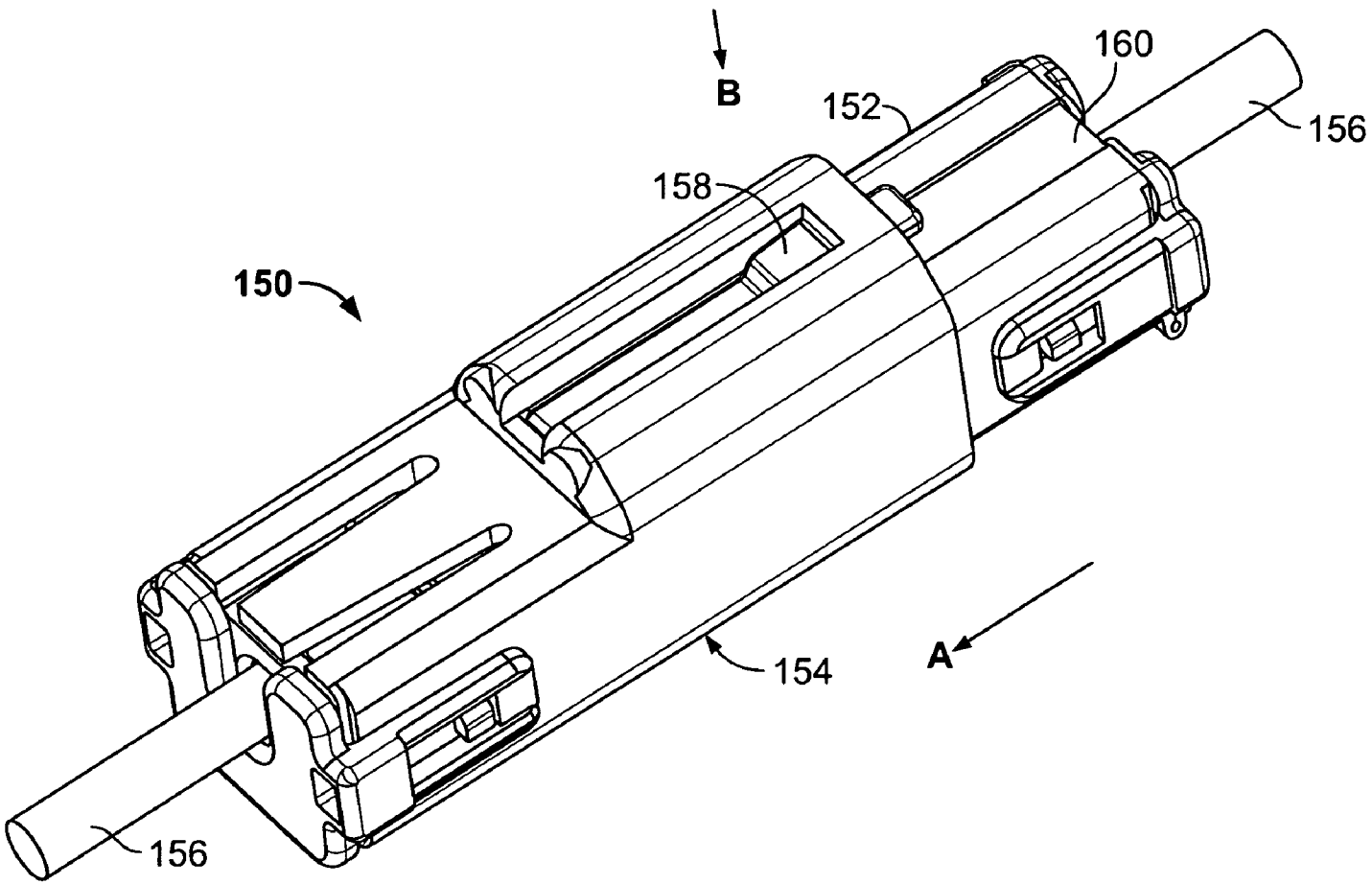
FIG. 2 (Prior Art)
FIG. 2 is a top perspective view of another known electrical connector assembly for a coaxial cable.

FIG. 2 illustrates another known coaxial cable connector assembly 150 which is better suited for larger cable than the connector assembly 100 (shown in FIG. 1). The cable connector assembly 150 includes a plug housing 152 and a receptacle housing 154 that each carry a coaxial cable 156. The receptacle housing 154 slidably receives the plug housing 152 in the direction of arrow A to electrically connect the coaxial cables 156. The plug and receptacle housings 152 and 154 are maintained in mating contact by a deflectable latch 158 extending from a top wall 160 of the plug housing 152.

Figure 3:
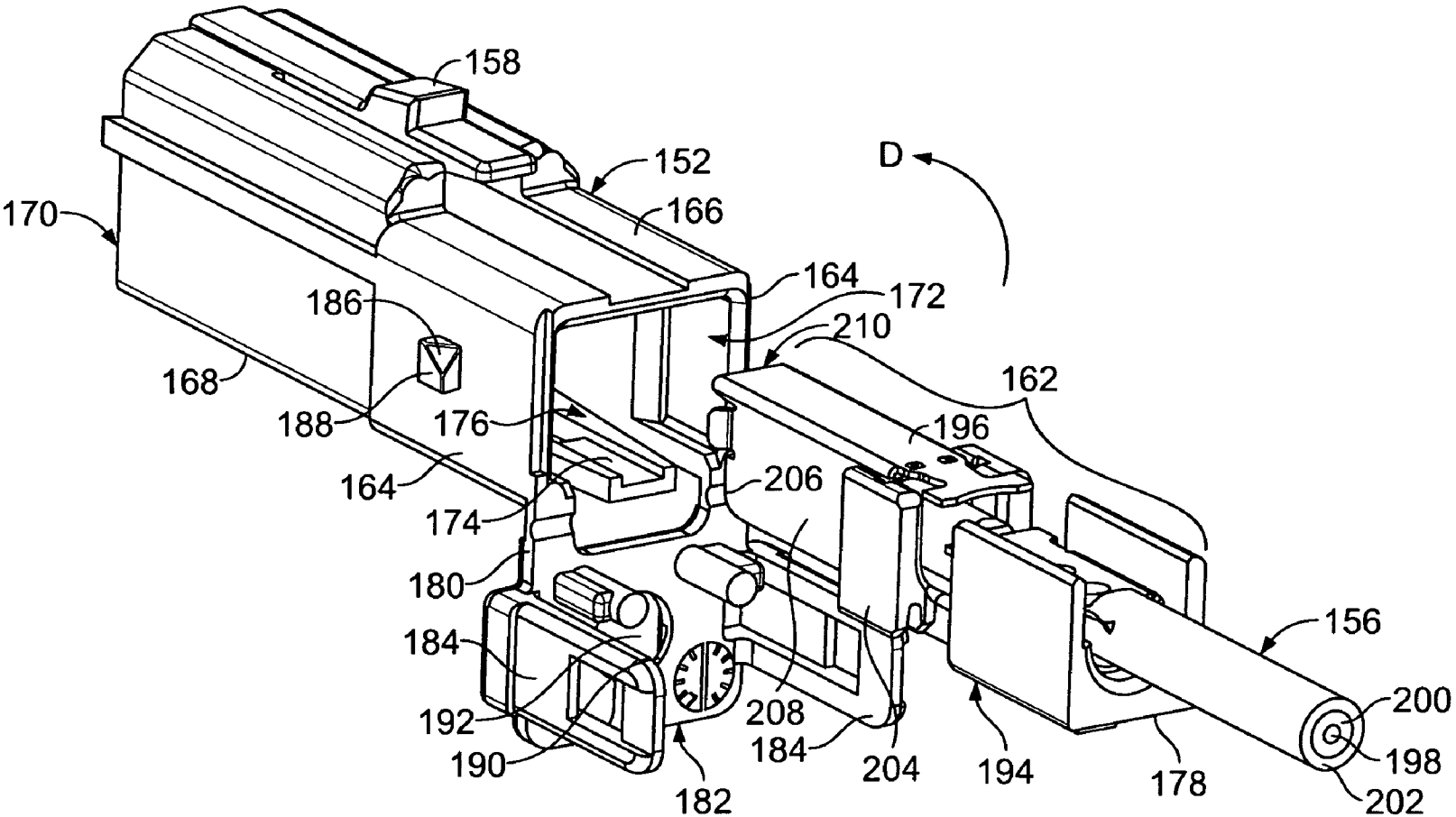
FIG. 3 (Prior Art)
FIG. 3 is an exploded view of a plug housing, coaxial cable, and dielectric subassembly for the connector assembly shown in FIG. 2.

FIG. 3 is an exploded view of the plug housing 152, the corresponding coaxial cable 156, and a dielectric subassembly 162. The plug housing 152 is defined by opposite side walls 164 formed with top and bottom walls 166 and 168 that include a mating end 170 and a reception end 172. The top wall 166 includes the deflectable latch 158. The bottom wall 168 includes a prong 174 with guide beams 176 extending inward within the plug housing 152. The guide beams 176 are aligned with, and slidably receive, the dielectric subassembly 162 along a rear wall 178 as the dielectric subassembly 162 is inserted into the plug housing 152. The guide beams 176 properly orient and retain the dielectric subassembly 162 within the plug housing 152.

The bottom wall 168 also includes hinges 180 that extend to an opened hatch 182. Retention latches 184 extend perpendicularly from the hatch 182 opposite each other. The retention latches 184 slide over sloped faces 186 of latch catches 188 extending from the side walls 164 and receive the latch catches 188 when the hatch 182 is rotated approximately 180 degrees in the direction of arrow D to close the reception end 172. Additionally, the hatch 182 includes a gap 190 leading to a cable hole 192 through which the coaxial cable 156 extends when positioned within the plug housing 152 and the dielectric subassembly 162.

Figure 4:
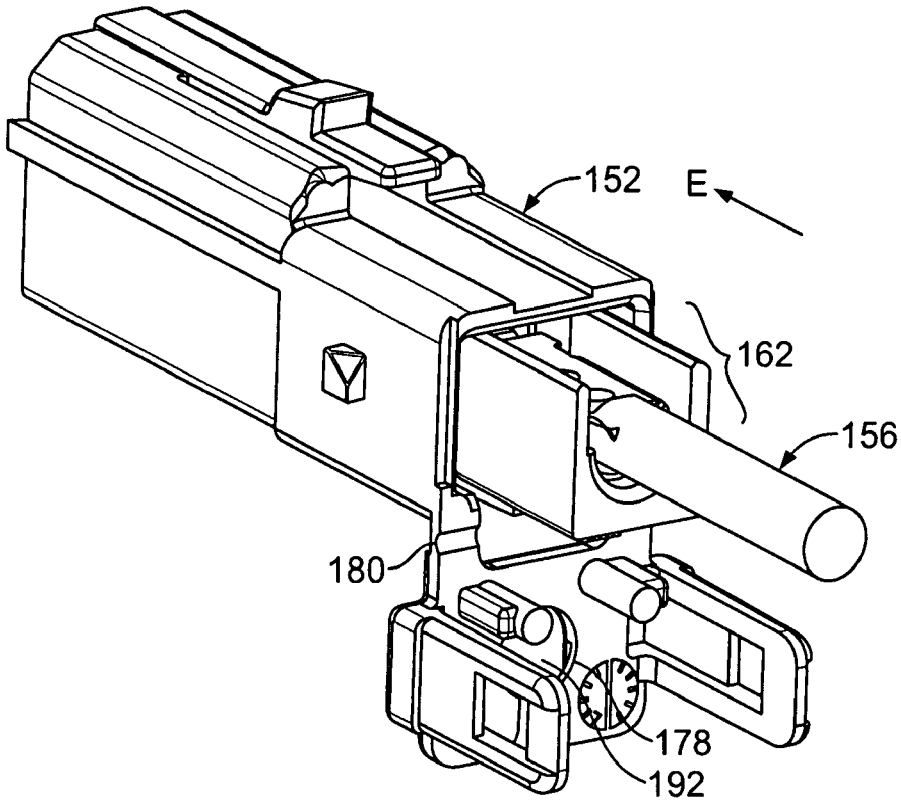
FIG. 4 (Prior Art)
FIG. 4 is a perspective view of the coaxial cable and dielectric subassembly shown in FIG. 2 partially assembled.

The dielectric subassembly 162 includes a plastic dielectric 194 connected to a rectangular metal outer shield 196. The dielectric subassembly 162 receives and retains the coaxial cable 156. The coaxial cable 156 includes an inner or center conductor 198 concentrically surrounded by a dielectric material 200 which in turn is concentrically surrounded by an outer conductor 202 that serves as a ground pathway. In FIG. 4, the outer conductor 202 is represented by, and may also be referred to hereinafter as, a cable braid 202 as an exemplary type of outer conductor. The coaxial cable 156 also typically includes a jacket around the cable braid (not shown in FIG. 3). The dielectric 194 includes a leading portion 204 that engages catches (not shown) on the side walls 164 inside the plug housing 152 that retain the dielectric subassembly 162 therein. The outer shield 196 includes coaxial cable displacement contacts that extend into the cable braid 202 to join the ground pathway. The outer shield 196 also includes anti-stubbing members 206 extending from a side wall 208 proximate an interface end 210 of the dielectric subassembly 162. The anti-stubbing members 206 engage corresponding anti-stubbing members (not shown) of a similar dielectric subassembly (not shown) within the receptacle housing 154 (shown in FIG. 2) such that the outer shield 196 overlaps a similar outer shield (not shown) within the receptacle housing 154.

A plug contact (not shown in FIG. 3 but similar to the plug contact 106 shown in FIG. 1) within the dielectric subassembly 162 engages the center conductor 198 of the coaxial cable 156 to join the electric signal pathway. The dielectric 194 includes a rectangular front portion that separates the plug contact from the outer shield 196 at the interface end 210.

In operation, and as shown in FIG. 4, the dielectric subassembly 162 retaining the coaxial cable 156 is inserted in the direction of arrow E into the plug housing 152. When the dielectric subassembly 162 is fully inserted into the plug housing 152, the hatch 182 is closed by rotating about the hinges 180 in the direction of arrow D (shown in FIG. 3). As the hatch 182 is closed, the coaxial cable 156 is contained within the gap 190 and slides therethrough into the cable hole 192. Additionally, as the hatch 182 is closed, the retention latches 184 slide along the side walls 164 and deflect outward away from each other about the sloped faces 186 until receiving the latch catches 188, thus holding the hatch 182 closed about the dielectric subassembly 162.

The receptacle housing 154 (shown in FIG. 2) is constructed similarly to the plug housing 152, and when the plug housing 152 is inserted into the receptacle housing as shown in FIG. 2, the receptacle contact is electrically coupled to the plug contact and the respective cables of the plug and receptacle are electrically connected.

Figure 5:
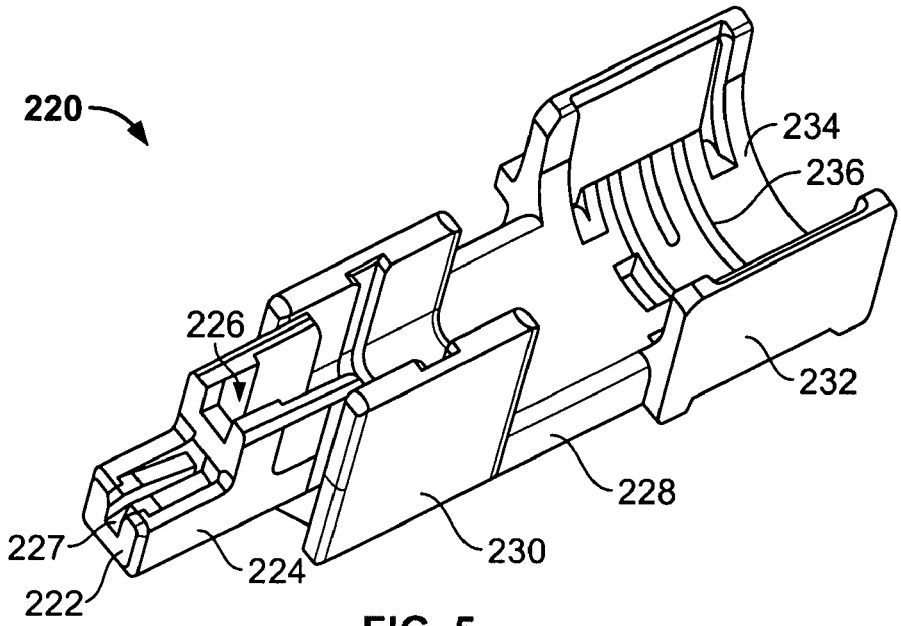
FIG. 5 (Prior Art)
FIG. 5 is a perspective view of a plug dielectric housing formed in accordance with an exemplary embodiment.

FIG. 5 is a perspective view of a plug dielectric housing 220 formed in accordance with an exemplary embodiment. The dielectric housing 220 includes a mating face 222 on a front end of a rectangular body section 224. The body section 224 is adapted to receive a leading end of a coaxial cable (not shown in FIG. 5) and a portion of a plug contact described below. A front end of the body section 224 includes a slot 227 that accepts a portion of the receptacle contact during assembly of the coaxial cable connector assembly. The dielectric housing 220 also includes an opening 226 through which the plug contact is exposed. A rear end of the body section 224 is formed with a shroud 228 through a joining section 230. The shroud 228 supports the coaxial cable.

A rear end of the shroud 228 is joined with a strain relief member 232 having an inner surface 234 having transverse arcuate grooves 236. The inner surface 234 of the strain relief member 232 and the shroud 228 form a substantially continuous surface which receives and supports a coaxial cable.

Figure 6:
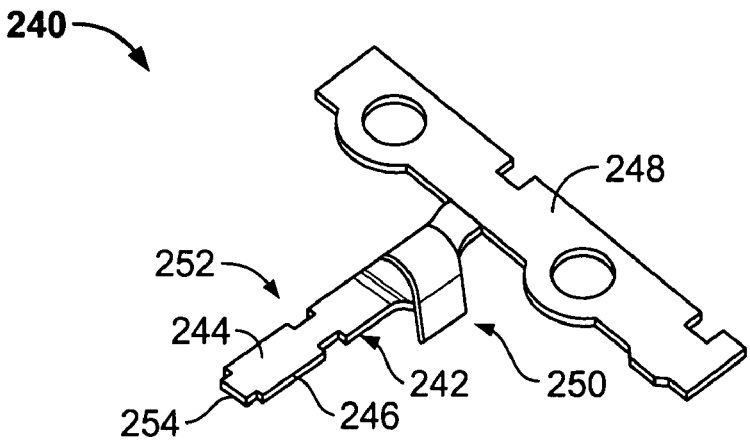
FIG. 6 (Prior Art)
FIG. 6 is a perspective view of a plug contact for the dielectric housing shown in FIG. 5.

FIG. 6 is a perspective view of a plug contact 240 for use with the dielectric housing 220 (shown in FIG. 5). The plug contact 240 represents a blade contact having a planar body section 242 with a top surface 244 and a bottom surface 246. The plug contact 240 is illustrated as being connected to a carrier strip 248, as used during the stamping and forming process, but which is removed therefrom.

The plug contact 240 includes a wire termination portion 250 and a mating portion 252. The wire termination portion 250 is configured to electrically and mechanically connect to the center conductor 198 (shown in FIG. 3) of the coaxial cable 156. In an exemplary embodiment, the wire termination portion 250 is terminated to the center conductor 198 by a wire crimp-type connection such that the wire termination portion 250 represents a crimp section. The mating portion 252 includes the planar body section 242 and has a beveled outer end 254 for engagement with a receptacle contact, as explained in further detail below.

Figure 7:
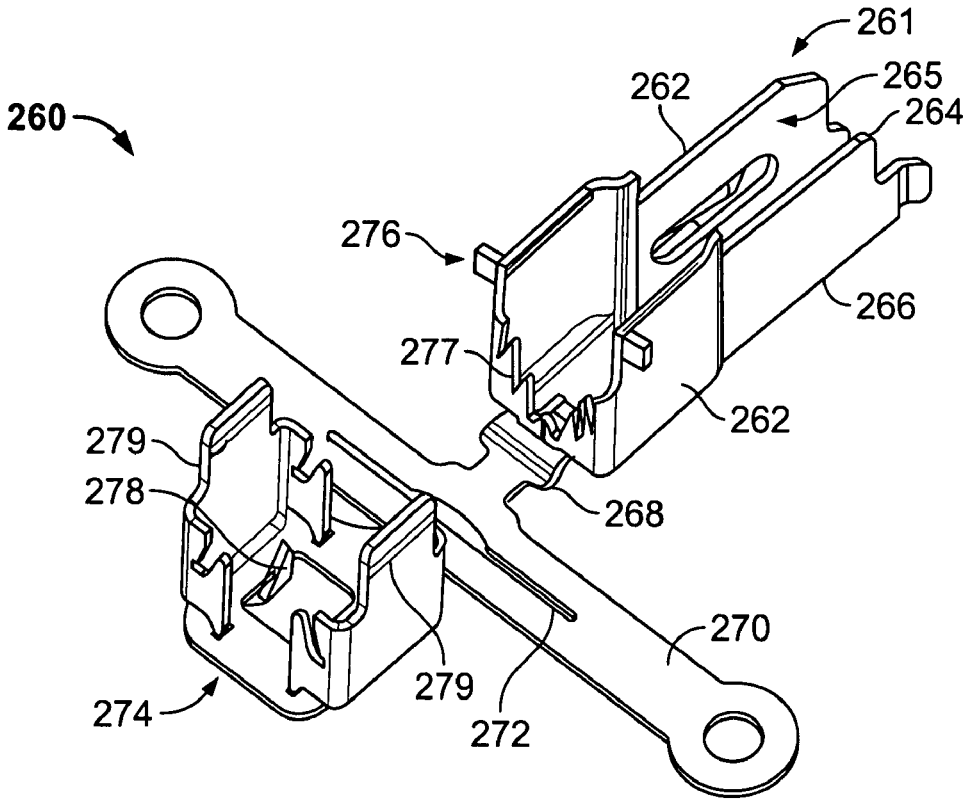
FIG. 7 is a perspective view of a plug shield formed in accordance with an exemplary embodiment.

FIG. 7 is a perspective view of an exemplary plug shield 260 formed in accordance with an exemplary embodiment. The plug shield 260 defines a ground shield that is configured to be electrically grounded with the conductive braid of the cable 156 (shown in FIG. 4). The plug shield 260 includes an elongated reception portion 261 having side walls 262 with a top surface 264 and a connecting wall 266 extending between the side walls 262. A shielded chamber 265 is defined by the connecting wall 266 and the side walls 262. The plug shield 260 includes an open side opposite the connecting wall 266. Optionally, the open side may be closed by another shield member, such as a receptacle shield or another secondary shield that closes at least a portion of the open top, to enclose the shielded chamber 265. Alternatively, the plug shield 260 may include four walls that form a rectangular body that completely encloses the chamber 265. In another alternative embodiment, the plug shield 260 may include two walls arranged generally orthogonally that mates with another shield member having a similar configuration to form the shielded chamber.

The connecting wall 266 includes a transition region 268 at a rear end thereof that is formed integrally with a laterally extending carrier strip or separation plate 270. The separation plate 270 includes a slot 272 to facilitate cutting of the separation plate 270 for installation of the shield 260. The separation plate 270 is, in turn, formed integrally with a strain relief crimp 274. After forming, the strain relief crimp 274 is physically separated from the transition region 268 and then separately secured to the coaxial cable.

A cable securing region 276 is formed at the rear end of the plug shield 260. The cable securing region 276 includes a serrated edge 277 on a portion thereof. The serrated edge 277 provides rough projections or teeth which directly engage and grip the cable braid as the shield 260 is installed. Optionally, the strain relief crimp 274 may also include a serrated edge to secure the strain relief crimp 274 to the cable. Alternatively, and as illustrated in FIG. 7, the strain relief crimp 274 may include a piercing barb 278 for piercing the insulated jacket of the coaxial cable and for securing the strain relief crimp 274 thereto. The strain relief crimp 274 also includes flaps 279 that fold over the coaxial cable to secure the strain relief crimp 274 to the coaxial cable. Optionally, the cable securing region 276 may also include flaps (not shown) similar to the flaps 279 of the strain relief crimp 274. The flaps may be folded over the coaxial cable to provide secondary shielding for larger cable as well as to provide mechanical stability to the connection between the shield 260 and the coaxial cable.

Figure 8:
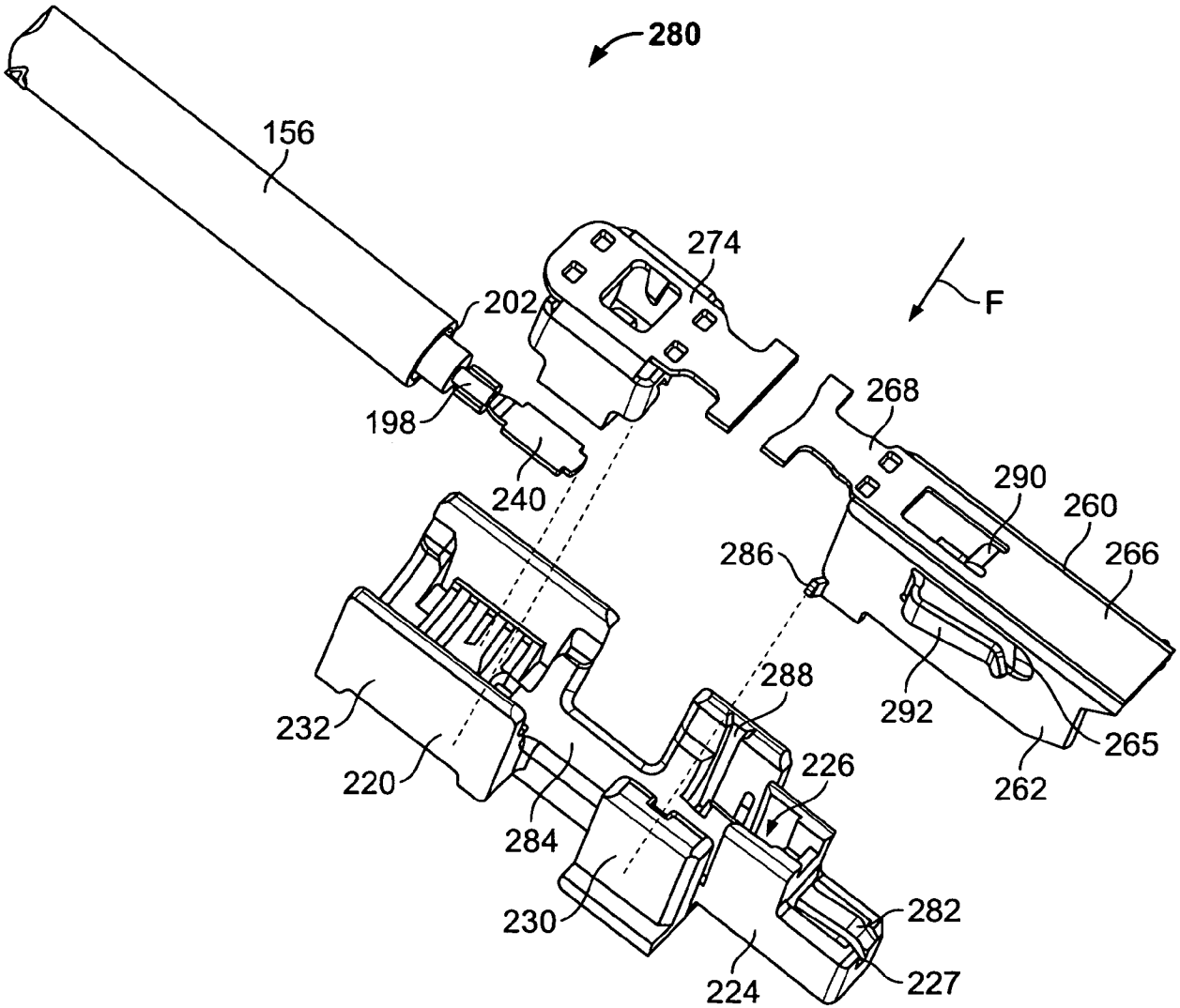
FIG. 8 is an exploded view of a plug assembly showing the cable, contact, dielectric and shield shown in FIGS. 5-7.

FIG. 8 is an exploded view of the cable 156, the plug contact 240, the dielectric housing 220 and the plug shield 260. The plug contact 240, the dielectric housing 220 and the plug shield 260 cooperate to form a plug assembly 280 that may be coupled to an end of a coaxial cable 156. The plug assembly 280 has a stripline geometry for easy interconnection of the cable 156 to a mating component, such as another cable or another component such as a circuit board or other type of connector.

The plug contact 240 is illustrated as being crimped to the center conductor 198 of the cable 156, such that the plug contact 240 includes a crimp section. The plug shield 260 and the strain relief crimp 274 are illustrated as being positioned vertically above the receptacle body section 224 and the strain relief member 232, respectively. Additionally, the separation plate 270 (shown in FIG. 7) is removed thus separating the strain relief crimp 274 from the transition region 268 of the plug shield 260.

During assembly, the coaxial cable 156 and the plug contact 240 are loaded into position with respect to the dielectric housing 220. For example, the plug contact 240 is positioned on a supporting ramp 282 at a front of the dielectric housing 220. Once assembled, the plug contact 240 lies above the slot 227. The crimp section is positioned within the opening 226 proximate the joining section 230. The coaxial cable 156 rests upon an inner surface 284 of the dielectric housing 220, such as along the joining section 230 and the strain relief member 232.

Once the coaxial cable 156 is positioned with respect to the dielectric housing 220, the strain relief crimp 274 and the plug shield 260 are then loaded into position, such as in the direction of arrow F. As illustrated in FIG. 8, during assembly of the plug shield 260, tabs 286 may project outward from the side walls 262 that are loaded into corresponding channels 288 within the walls of the dielectric housing 220. The tabs 286 and channels 288 properly align the plug shield 260 with the dielectric housing 220 and may aid in securing the plug shield 260 to the dielectric housing, such as by a friction fit. During mating, the serrated edge 277 (shown in FIG. 7) engages the cable braid 202 of the coaxial cable 156.

In an exemplary embodiment, and as illustrated in FIG. 8, the plug shield 260 includes a compensating tab 290 extending inwardly into the shielded chamber 265. The compensating tab 290 is positioned within the shielded chamber 265 such that the compensating tab 290 is positioned in proximity to the plug contact 240 and/or the inner conductor 198. Optionally, the compensating tab may be axially aligned with the crimp section of the contact 240. The compensating tab 290 may extend inwardly from the connecting wall 266 and/or one or both of the side walls 262. In the illustrated embodiment, the compensating tab 290 extends inward from the connecting wall 266. By extending inward from the connecting wall 266 and/or the side walls 262, the compensating tab 290 is configured to be positioned relatively closer to the plug contact 240 and/or the inner conductor 198 than the walls 266, 262. The compensating tab 290 is electrically connected to the plug shield 260 and operates to control an electrical characteristic of a section of the plug assembly 280. For example, the compensating tab 290 may provide compensation that changes (e.g. increases) the capacitance of a section of the plug assembly 280. By controlling the capacitance, the impedance of a section of the plug assembly 280 may be controlled. Optionally, the compensating tab 290 may be used to match the impedance within the plug assembly 280 to a certain impedance of the coaxial cable 156. The compensating tab 290 may control other electrical characteristics of a section of plug assembly 280, such as the inductance and the like.

In an exemplary embodiment, the compensating tab 290 is integrally formed with the plug shield 260, such as by a stamping process. For example, a U-shaped slot may be cut from the connecting wall 266 to define an elongated tab connected at an end thereof to the connecting wall 266. The tab may have any shape or size depending on the particular application. The elongated tab may then be bent into a predetermined shape by a forming process to form the compensating tab 290. In an alternative embodiment, the compensating tab 290 may be otherwise formed integrally with the plug shield 260 during manufacturing of the plug shield 260. In other alternative embodiments, the compensating tab 290 may be formed separately from, and then electrically and mechanically connected to, the plug shield 260 during an assembly step. For example, the tab 290 may be a component that is welded or soldered to a surface of the connecting wall 266.

In an exemplary embodiment, and as illustrated in FIG. 8, the plug shield 260 includes a clip 292 formed integrally with one of the side walls 262 of the plug shield 260. The clip 292 is used to securely couple the plug shield 260 with a corresponding receptacle shield, as described in further detail below. The clip 292 engages the receptacle shield and holds the shields together, such as by a friction fit. The clip 292 is integrally formed with the plug shield 260, such as by a stamping process. For example, a U-shaped slot may be cut from the side wall 262 to define an elongated tab connected at an end thereof to the respective side wall 262. The elongated tab may then be bent into a predetermined shape by a forming process to form the clip 292. The opening created by stamping the clip 292 is generally covered by the receptacle shield during mating such that the shielded chamber 265 is fully covered by the shields.

Figure 9:
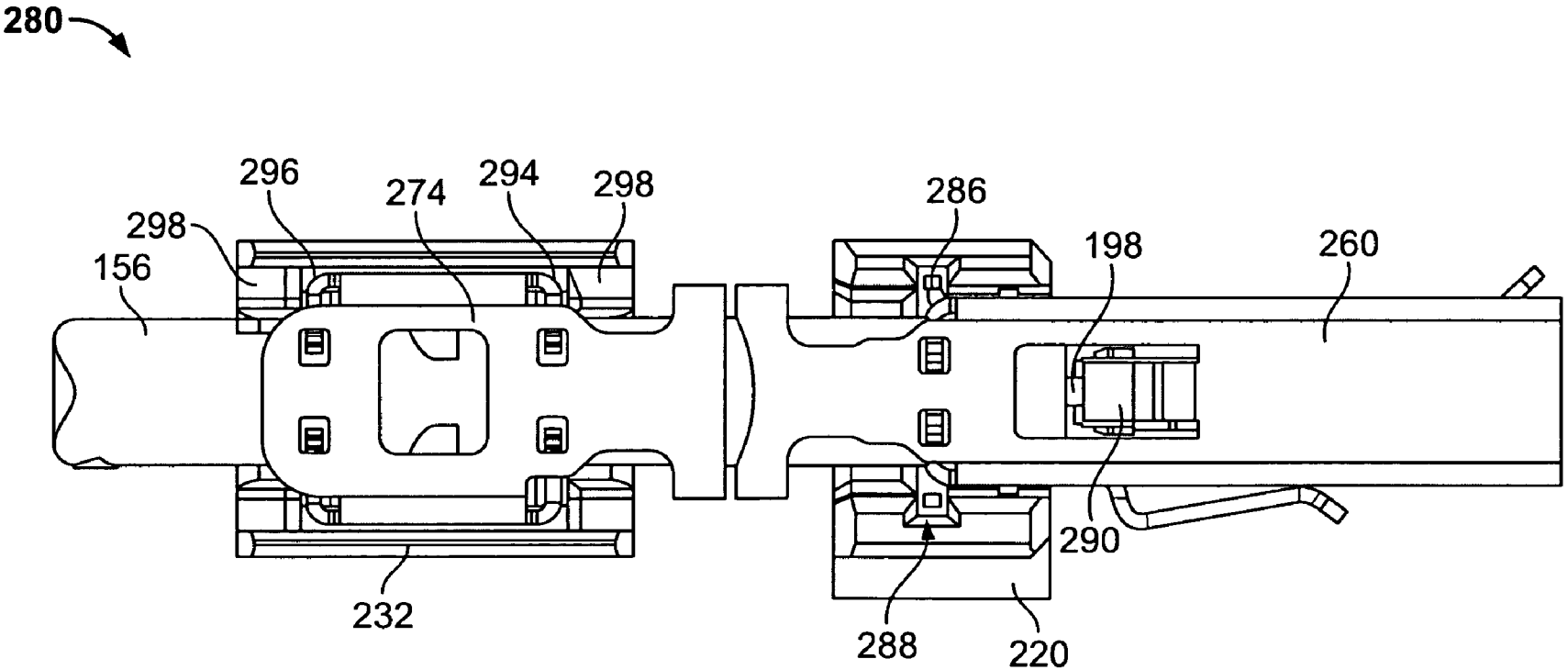
FIG. 9 is a top assembled view of the plug assembly shown in FIG. 8.

FIG. 9 is a top assembled view of the plug assembly 280 secured to the end of the coaxial cable 156. The plug shield 260 is mated with the dielectric housing 220. The tabs 286 are loaded into the corresponding channels 288 within the walls of the dielectric housing 220. The compensating tab 290 is illustrated as being axially aligned with the center conductor 198.

The strain relief crimp 274 is coupled to the coaxial cable 156 and is received within the strain relief member 232. The strain relief crimp 274 may include front and rear edges 294, 296 that rest against shoulders 298 formed in the strain relief member 232. The strain relief crimp 274 may thus be axially held in place within the strain relief member 232 to provide rigidity to the plug assembly 280 and/or to hold the coaxial cable 156 in position relative to the plug assembly 280.

Figure 10:
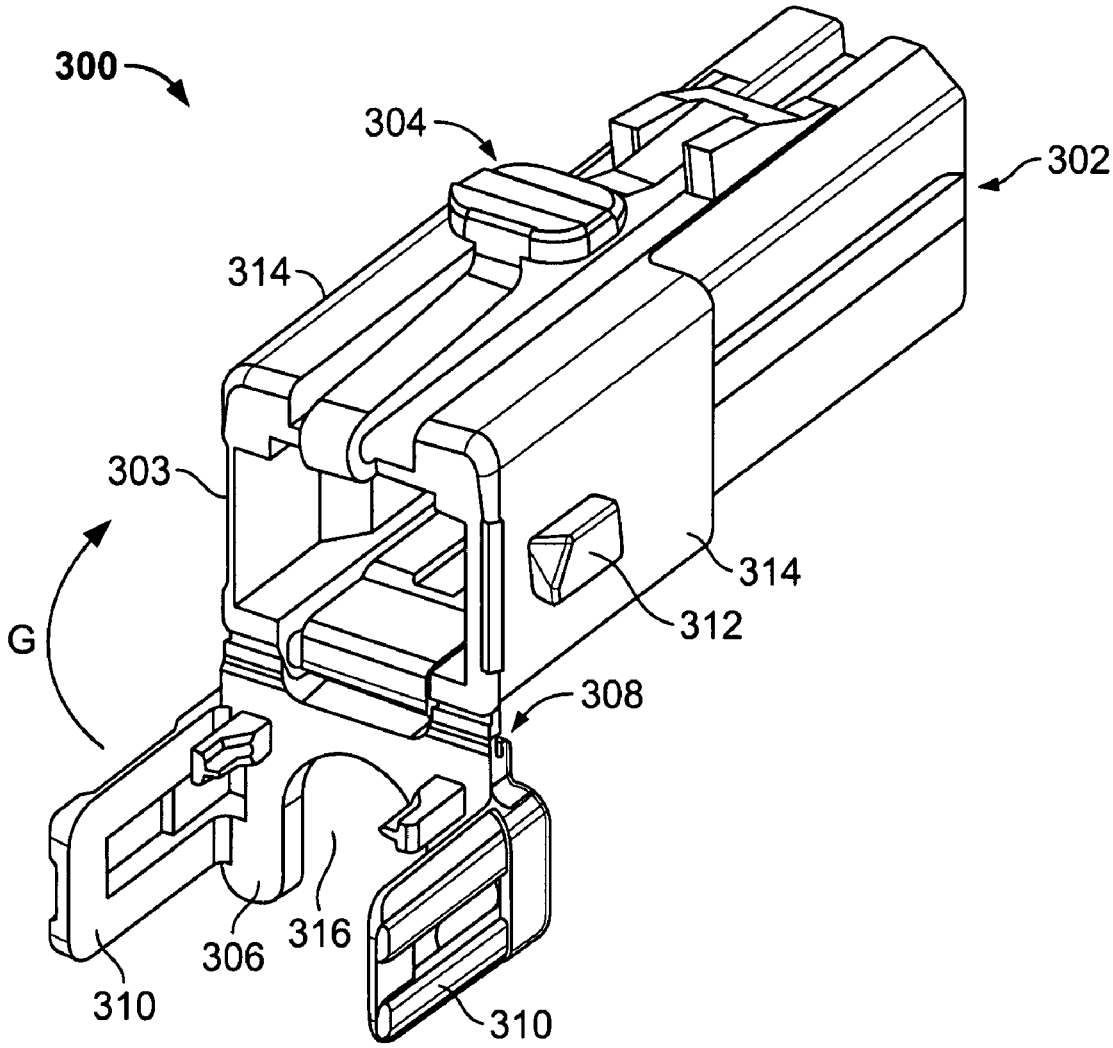
FIG. 10 (Prior Art)
FIG. 10 is a perspective view of a plug outer housing for the plug assembly shown in FIGS. 8 and 9, for use in an alternative embodiment.

FIG. 10 is a perspective view of a plug outer housing 300 for the plug assembly 280 (shown in FIGS. 8-9). The plug housing 300 and the plug assembly 280 may collectively form an encased plug assembly which capably connects larger cables as the plug housing 300 provides additional stability to the plug assembly 280 (shown in FIG. 8).

The plug housing 300 is configured to mate with a similar receptacle case configured to hold a corresponding receptacle assembly, such as the receptacle assembly described below with reference to FIG. 11. The plug housing 300 includes a mating end 302 adapted to be inserted into a mating end of the receptacle case, and a reception end 303 adapted to receive the plug dielectric housing 220 and associated plug contact 240, plug shield 260, and cable (not shown in FIG. 10). A latch beam 304 is provided in one side of the plug housing 300 which engages a corresponding slot in the receptacle case when the plug housing 300 and the receptacle case are joined. The latch beam 304 may be used to lock the plug housing 300 within the receptacle case.

The reception end 303 includes a rotatable hatch 306 mounted upon a hinge 308. Retention latches 310 extend from the hatch 306, and when the hatch 306 is rotated approximately 180 degrees in the direction of arrow G to close the reception end 303, the retention latches 310 engage latch catches 312 on each side wall 314 of the plug housing 300. A cable opening 316 is provided in the latch 306 which receives and supports a cable (not shown in FIG. 10) when the hatch 306 is closed.

Figure 11:
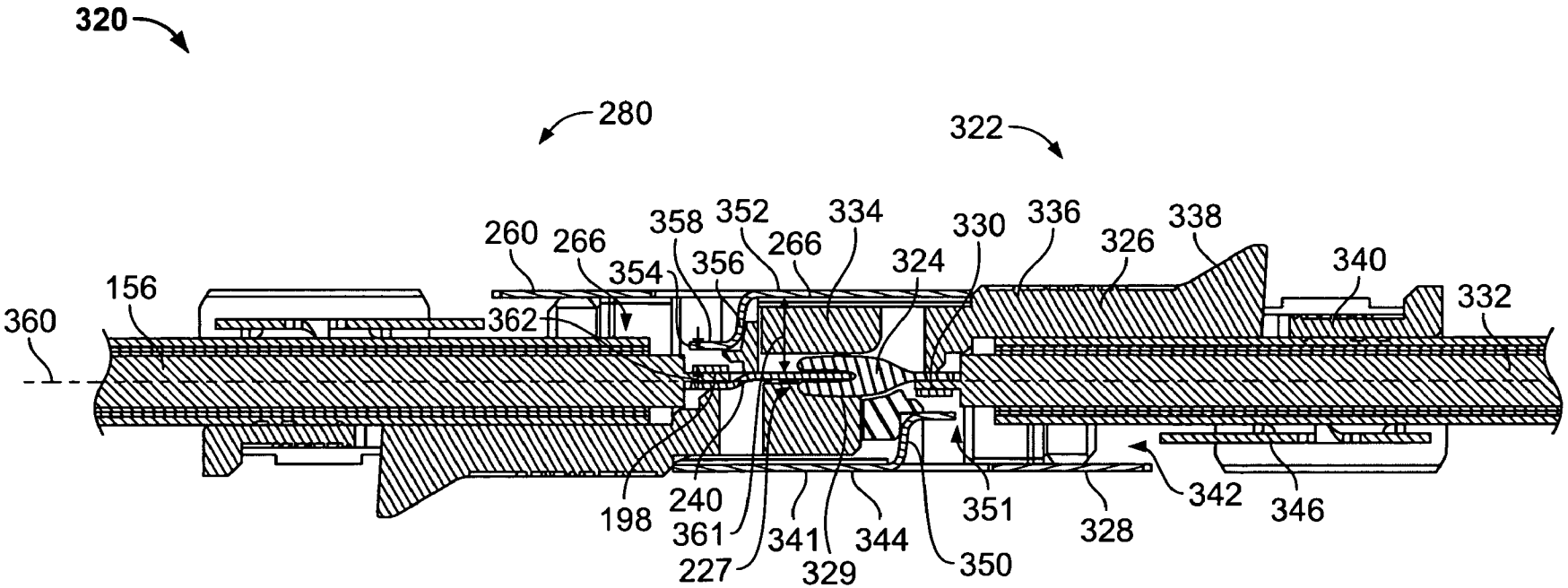
FIG. 11 is a cross sectional view of a cable connector assembly including the plug assembly shown in FIGS. 8 and 9 mated with a receptacle assembly.

FIG. 11 is a cross sectional view of a cable connector assembly 320 including the plug assembly 280 shown in FIGS. 8 and 9 mated with a receptacle assembly 322. The receptacle assembly 322 includes a receptacle contact 324, a receptacle housing 326 and a receptacle ground shield 328. The receptacle contact 324 defines a mating contact for the plug contact 240. The plug contact 240 and the receptacle contact 324 each define blade contacts having planar body sections. The receptacle contact 324 includes forked legs 329 that mechanically and electrically connect to the plug contact 240. In an exemplary embodiment, the receptacle contact 324 is planar and is oriented generally perpendicular with respect to the plug contact 240. When the receptacle contact 324 and the plug contact 240 are mated, the receptacle contact is received within the slot 227. The receptacle contact 324 is coupled to a center conductor 330 of a coaxial cable 332. In the illustrated embodiment, the receptacle contact 324 is coupled to the center conductor 330 by a crimp-type connection.

The receptacle housing 326 is formed similar to the plug housing 220 and includes a body section 334, a joining section 336, a shroud 338 and a strain relief member 340. The receptacle housing 326 receives the coaxial cable 332 and positions the receptacle contact 324 for mating with the plug contact 240.

The receptacle shield 328 includes a reception portion 341 having a shielded chamber 342 defined by a connecting wall 344 and side walls (not shown) similar to the plug shield 260. The receptacle housing 326 is received in the shielded chamber 342. The receptacle shield 328 includes an open side opposite the connecting wall 344. When the receptacle assembly 322 and the plug assembly 280 are mated with one another, the plug shield 260 and the receptacle shield 328 cooperate to completely surround the shielded chambers 265 and 342. For example, the connecting walls 266 and 344 close the open sides of each of the shields 260, 328.

The receptacle shield 328 also includes a strain relief crimp 346 that is received in the strain relief member 340 of the receptacle housing 326. The strain relief crimp 346 is securely coupled to the coaxial cable 332.

The receptacle shield 328 includes a compensating tab 350 extending inward into the shielded chamber 342 from the connecting wall 344. As with the plug shield 260, the compensating tab 350 may extend inward from one of the side walls in addition to, or in the alternative to, the illustrated embodiment. In another alternative embodiment, only one of the plug shield 260 and the receptacle shield 328 may include a compensating tab. The compensating tab 350 is formed in a similar manner as the compensating tab 290 and may extend into an opening 351 in the receptacle housing 326. Each of the compensating tabs 290, 350 are supported by a portion of the respective housings 220, 326 for mechanical stability and/or to position the compensating tab 290, 350 in a proper position with respect to the respective contact 240, 324. However, the compensating tabs 290, 350 may be designed to be self-supporting and may be freely received within the respective openings 226, 351.

In an exemplary embodiment, the compensating tabs 290, 350 are generally L-shaped and are cantilevered from a fixed end 352. The compensating tabs 290, 350 also include a free end 354 opposite the fixed end 352. The compensating tabs 290, 350 include a radial section 356 extending generally perpendicular with respect to the connecting wall 266, 344, respectively, and an axial section 358 extending generally perpendicular with respect to the radial section 356. The axial section 358 extends substantially parallel to a longitudinal axis 360 of the cable connector assembly 320 between the radial section 356 and the free end 354. As illustrated in FIG. 11, the contacts 240, 324 are positioned a predetermined first distance 361 from the respective shield 260, 328. The distance 361 provides a certain amount of interaction between the contacts 240, 324 and the respective shields 260, 328, which provide a predetermined electrical characteristic, such as impedance, for the respective assembly 280, 322. By using the compensating tabs 290, 350, which position the axial sections 358 at a predetermined second distance 362 that is less than the first distance 361, the electrical characteristics of the respective assemblies 280, 322 may be changed, as explained in further detail below.

The compensating tabs 290, 350 are both sized and shaped to be positioned at a predetermined position with respect to the respective contacts 240, 324. The compensating tabs 290, 350 are positioned with respect to the respective contacts 240, 324 to control an electrical characteristic of a section of the cable connector assembly 320 and/or the contact 240, 352. For example, the compensating tabs 290, 350 are positioned with respect to the respective contacts 240, 324 to provide a predetermined impedance for at least a section of the respective assembly 280, 322 and/or for the cable connector assembly 320. The compensating tabs 290, 350 may be used to match the impedances of the sections of the connector containing contacts 240, 324 with a certain impedance of the coaxial cable 156, 332. The compensating tabs 290, 350 may be used to decrease the impedances of the respective sections of the connector containing contacts 240, 324 by a predetermined amount. The position (e.g. the distance from) of the compensating tabs 290, 350 with respect to the contacts 240, 324, may control the impedance. The position (e.g. the distance from) of the contacts 240, 324 from the shields, may control the impedance. Additionally, the length of the axial section 358 may control the impedance. Furthermore, the type of material between the compensating tabs 290, 350 and the respective contacts 240, 324, such as the dielectric material of the housing or air, may control the impedance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial cable connector comprising:

a connector housing configured to receive a coaxial cable having inner and outer conductors;

a ground shield including a plurality of walls cooperating to define a shielded chamber, at least a portion of the connector housing received within the shielded chamber, the walls configured to be connected to the outer, conductor of the coaxial cable; and a center contact configured to be connected to the inner conductor of the coaxial cable, the center contact being supported by the connector housing between the walls of the ground shield in a stripline geometry;

wherein at least one of the walls includes a compensating tab extending inwardly therefrom, the compensating tab extending into the connector housing such that the compensation tab is configured to be positioned proximate at least one of the center contact and the inner conductor of the coaxial cable, wherein the compensating tab includes an axial section extending substantially parallel to a longitudinal axis of the center contact and a radial section extending between the axial section and the ground shield.

2. The connector of claim 1, wherein the compensating tab is formed integral with the ground shield.

3. The connector of claim 1, wherein the compensating tab includes a radial section extending generally perpendicular with respect to the wall of the ground shield and an axial section extending generally perpendicular with respect to the radial section.

4. The connector of claim 1, wherein the compensating tab is positioned with respect to the center contact to provide a predetermined impedance of at least a section of the coaxial cable connector.

5. The connector of claim 1, wherein one of the walls of the ground shield is positioned a first distance from the center contact, and wherein the compensating tab is positioned a second distance from the center contact that is less than the first distance.

6. The connector of claim 5, wherein the compensating tab includes an axial section extending parallel to, and spaced apart from, the center contact by the second distance, the second distance being approximately half the first distance.

7. The connector of claim 1, wherein the center contact is configured to be connected to the inner conductor of the coaxial cable by a crimp connection such that the center contact includes a crimp section, the compensating tab-extending parallel to, and spaced apart from, the crimp section.

8. The connector of claim 1, wherein the connector housing includes a plurality of walls including a bottom wall, one of the walls of the ground shield extending along the bottom wall, the bottom wall including an opening substantially aligned with the center contact, the compensating tab received with the opening such that the compensating tab is interior of the connector housing with respect to the bottom wall and such that the compensating tab is more closely positioned with respect to the center contact than the bottom wall.

9. A coaxial cable connector assembly, comprising:

a receptacle assembly and a plug assembly configured for mating engagement with the receptacle assembly, wherein at least one of the receptacle assembly and the plug assembly are configured for coupling to a coaxial cable having a center conductor and a ground conductor, and wherein at least one of the receptacle assembly and the plug assembly comprises:

a contact configured for connection to the center conductor at a mating section of the contact;

a dielectric housing configured to receive the contact and a portion of the cable; and a ground shield configured for connection to the ground conductor of the coaxial cable, the ground shield includes a plurality of walls defining a shielded chamber that receives at least a portion of the dielectric housing, at least one of the walls includes a compensating tab extending therefrom into the shielded chamber, the compensating tab extending along, in close proximity to, the mating section of the contact, wherein the compensating tab includes an axial section extending substantially parallel to a longitudinal axis of the contact and a radial section extending between the axial section and the ground shield.

10. The connector assembly of claim 9, wherein the compensating tab is positioned in close proximity to the contact to provide a predetermined impedance of at least a section of the coaxial cable connector.

11. The connector assembly of claim 9, wherein the contact is configured to be connected to the inner conductor of the coaxial cable by a crimp connection such that the mating section defines a crimp section, the compensating tab being substantially, axially aligned with the crimp section.

12. The connector assembly of claim 9, wherein the receptacle assembly comprises:

a mating contact configured for mating contact with the contact of the plug assembly;

a receptacle housing configured to receive the mating contact, the receptacle housing having a mating face configured to engage a corresponding mating face of the dielectric housing; and a receptacle ground shield configured for connection to the ground shield of the plug assembly, the receptacle ground shield and the ground shield of the plug assembly cooperating to completely surround and shield the mating contact and the contact of the plug assembly.

13. The connector assembly of claim 12, wherein the mating contact is configured for connection to a center conductor of a second coaxial cable, and wherein the receptacle ground shield is configured for connection to a ground conductor of the second coaxial cable.

14. The connector assembly of claim 12, wherein the receptacle ground shield includes a second compensating tab axially aligned with, and extending toward, the mating contact.

15. A coaxial cable connector comprising:

a connector housing configured to receive a coaxial cable having inner and outer conductors;

a center contact configured to be connected to the inner conductor of the coaxial cable, the center contact being supported by the connector housing;

a ground shield including a plurality of walls cooperating to define a shielded chamber, the shielded chamber receiving at least a portion of the connector housing and center contact therein, the walls being configured to be connected to the outer conductor of the coaxial cable; and a compensating tab extending from one of the walls of the ground shield into the connector housing, the compensating tab having an axial section extending substantially parallel to a longitudinal axis of the center contact and a radial section extending between the axial section and the ground shield, the axial section being spaced apart from the center contact by a predetermined distance.

16. The connector of claim 15, wherein the compensating tab is positioned at the predetermined distance to provide a predetermined impedance of at least a section of the coaxial cable connector.

17. The connector of claim 15, wherein the axial section is approximately centered between the ground shield and the center contact.

18. The connector of claim 15, wherein the compensating tab is L-shaped with the radial section being perpendicular with respect to the corresponding wall of the ground shield, at least one of the axial section and the radial section engaging an interior support wall of the connector housing to support the compensating tab with respect to the center contact.

* * * * *